91-446

10/22/85 XR 4,548,239

United States Patent [19]

Eskildsen

[11] Patent Number: 4,548,239

[45] Date of Patent: Oct. 22, 1985

[54] HYDRAULIC SLIDE VALVE

[75] Inventor: Christian Eskildsen, Nybøl, Denmark

[73] Assignee: Danfoss A/S, Nordborg, Denmark

[21] Appl. No.: 570,854

[22] Filed: Jan. 16, 1984

[30] Foreign Application Priority Data

Jan. 21, 1983 [DE] Fed. Rep. of Germany ..... 3302000

[51] Int. Cl.[4] ..... F15B 13/02

[52] U.S. Cl. ..... 137/625.68; 91/446; 91/451; 91/518; 137/596; 137/596.13

[58] Field of Search ..... 91/446, 451, 512, 518, 91/531; 137/596, 596.13, 625.68

[56] References Cited

U.S. PATENT DOCUMENTS

| | | | |
|---|---|---|---|
| 3,488,953 | 1/1970 | Haussler . | |
| 3,592,216 | 7/1971 | McMillen | 91/518 X |
| 3,602,243 | 8/1971 | Holt et al. | 91/518 X |
| 3,718,159 | 2/1973 | Tennis | 137/596.13 X |
| 3,881,512 | 5/1975 | Wilke | 91/446 X |
| 4,030,522 | 6/1977 | Heiser | 137/596.13 |
| 4,051,868 | 10/1977 | Andersen | 137/596.13 |

*Primary Examiner*—Gerald A. Michalsky
*Attorney, Agent, or Firm*—Wayne B. Easton

[57] ABSTRACT

The invention relates to a hydraulic control valve assembly for controlling a consumer unit such as a servomotor of a vehicle steering system. The valve assembly has a conventional port arrangement which includes two selectively pressurizeable and drainable motor ports connectable to a servomotor and supply and exhaust ports connectable respectively to a pump and a drain tank. A slide valve has a central wall section between two motor ports which completely block a central supply port when the slide valve is in a neutral position. Two metering control load sensing ports are on opposite sides of the supply port and when the slide valve is in a neutral position the load sensing ports are in throttling relation to the slide valve motor ports. The load sensing ports are sufficiently closely adjacent the supply port that when in operation when the supply port is partially overlapped by one of the motor ports one of the load ports on the opposite side of the supply port is closed by the central section of the slide member.

3 Claims, 1 Drawing Figure

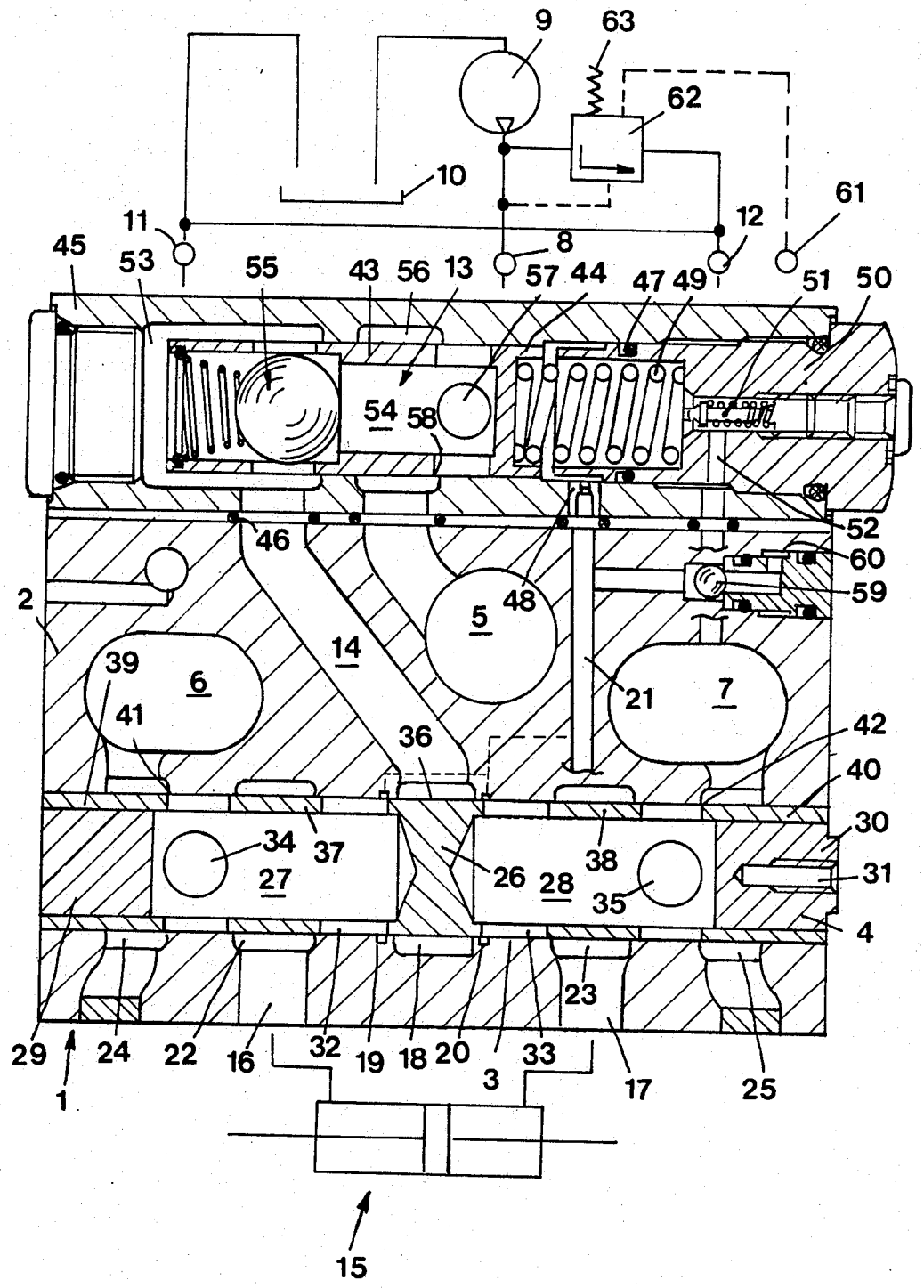
9
63
62
10
61
11
12
8
45
53
55
43
56
13
57
44
47
49
51
50
54
58
52
46
60
59
2
48
5
14
39
6
21
7
41
36
42
40
30
34
37
38
31
27
26
28
35
4
23
29
24
22
16
32
19
18
20
3
33
17
25
1
15

HYDRAULIC SLIDE VALVE

The invention relates to a hydraulic slide valve comprising a housing bore having axially offset control orifices, particularly annular grooves, of which the central control orifice is connected to a supply passage for the pressure fluid, two control orifices symmetrical thereto are each connected to a load connection, two control orifices symmetrically outside thereof are connected to the container, and two further symmetrical control orifices are connected to a metering passage, and comprising a slide which is axially displaceable in the housing bore and has axially offset control orifices by way of which the load connection control orifices are, on operation, connected at alternate sides to a supply passage control orifice or to a container control orifice from which they are separated in the neutral position and by way of which each metering passage control orifice is, on operation, connected to a load connection control orifice and in the neutral position to a container control orifice.

In a known hydraulic slide valve (DE-AS 25 14 624), the control orifices of the housing bore as well as those of the slide are formed by annular grooves. The metering passage annular grooves are symmetrically outside all the other annular grooves and are connected in the neutral position by way of a first outer annular groove of the slide to the container annular groove and in the operating condition by way of a second outer annular groove of the slide and a passage extending in the slide to an inner annular groove of the slide that is permanently connected to a load connection annular groove. In such a construction, the respective load pressure obtains in the metering passage during operation and the container pressure in the neutral position. It is possible to control pressure regulators with the aid of the pressure in the metering passage. For example, a squeezing position of the pressure regulator may precede the slide valve in order to maintain the pressure in the supply passage above the load pressure to a predetermined extent during operation; this results in a substantially proportional valve control. In the presence of a plurality of slide valves, the pressure regulator may also be associated with the pump and set the pump pressure to a predetermined value above the highest load pressure of the slide valves; in this way, the pump output can be adapted to the requirements. In the neutral position, the pressure regulators assume a rest position defined by a spring. It is also possible to employ both types of pressure regulators simultaneously. By reason of the multiplicity of annular grooves in the slide, the known slide must be comparatively long. The housing dimensions are correspondingly large. The seal between the individual annular grooves is effected by the overlapping parts of the bore and slide circumference. This results in corresponding leakage losses.

Another slide valve is known (DE-AS 16 50 312), in which the metering passage control orifices are bores closely adjacent to a supply passage annular groove and are covered in the neutral position by the central collar of a slide. The metering passage communicates with the container connection by way of a supplementary conduit which extends by way of a respective transverse bore in the slide. This arrangement is suitable only for a pressure regulator which is common to all the slide valves but not for a universally applicable slide valve which has the container pressure in the metering passage irrespective of the other slide valve when it is disposed in the neutral position.

It is also known (DE-OS 24 20 242), to make the slide of a slide valve in the form of a hollow slide which, at both sides of a central dividing wall, has a cavity closed at the ends by a plug. An inner control orifice adjacent to the dividing wall and an outer control orifice axially offset towards the side extends from each cavity to the circumference. At both sides of the central supply passage annular groove which communicates with the pump connection, there are two metering passage annular grooves which permanently communicate with the associated first control orifice and, by way of check valves, to the pressure chamber of a pressure regulator which controls a bypass passage between the pump connection and container connection. Between the inner and outer control orifice there is in each case a spring-loaded check valve. These check valves ensure that, on operation, an adequate pressure is built up before communication with the load is established; in that event, they are disposed in the flow path and cause pressure losses. The pressure chamber of the pressure regulator is permanently connected to the container by way of leakage paths and this influences the control of the pressure regulator.

The invention is based on the problem of providing a hydraulic slide valve of the aforementioned kind which, whilst maintaining its function of controlling a pressure regulator, permits shorter constructions and simpler manufacture.

This problem is solved according to the invention in that the metering passage control orifices are adjacent to the supply passage control orifice, that the slide is provided at both sides of a central dividing wall with a cavity which is closed at the ends and has control orifices leading to the cylindrical circumference, namely inner control orifices adjacent to the dividing wall and outer control orifices axially offset towards the sides, and that in the neutral position the supply passage and load connection control orifices are closed by the slide and the metering control orifices are each connected by way of a cavity to a container connection control orifice.

In this construction, the two cavities and the associated control orifices of the slide serve to connect the supply passage control orifice to the one load connection control orifice and the other load connection control orifice to the container control orifice during operation and, in the neutral position, to connect the two metering passage control orifices to the container orifice. Conversely, the one metering passage control orifice is closed during operation and the other is connected to the cavity which is at load pressure. The slide can be short because it need only slightly project beyond the container control orifices. Manufacture is simple because it is only necessary to provide a cylindrical body with cavities which need have no inserts and with control orifices that are connected thereto. In comparison with a slide valve of which the slide has annular grooves and collars, the flow losses are small. So are the leakage losses because larger sealing faces are available on the peripheral surface of the slide.

It is particularly favourable if the metering passage control orifices are so closely adjacent to the supply passage control orifice that, on operation, the supply passage control orifice is partially overlapped by the one inner control orifice and the metering passage control orifice communicating with the other inner control orifice is closed by the central portion of the slide disposed between the two inner control orifices. The close the metering passage control orifices are disposed to the supply passage control orifice, the smaller can be the axial length of the hollow slide and the smaller will be the dead zone between the two operating zones.

It is also favourable for the central portion of the hollow slide partially to overlap both metering passage control orifices in the neutral position. In this way, the hollow piston has to travel only a short distance out of the neutral position until the one metering passage control orifice is closed and pressure fluid is supplied to the load.

Further, it is advisable for the container connection control orifices to be so arranged that their confronting sides slightly overlap the outer control orifices in the neutral position. In this way, the cavity is connected in the neutral position to the container connection control orifice by way of a throttling position. However, slight displacement of the hollow slide will suffice for separating the container connection from the cavity on the supply side.

In a preferred embodiment, the inner and outer control orifices consist of radial bores. Such radial bores are easy to make. In particular, two of these radial bores can be produced in one operation on opposite sides of the periphery.

It is advisable for the radial bores to be of equal size but for the number of outer radial bores to be larger than the number of inner radial bores. The larger number of outer radial bores leads to a comparatively low pressure loss between the cavity and container whereas the co-operation of the smaller number of inner control orifices with the supply passage control orifice results in a very fine control.

In particular, it is recommended that the slide be produced by cold flow, the inner and outer control orifices are bores and the cavities are closed by plugs. This results in a particularly simple production.

In a preferred embodiment, a pressure regulator comprises a cylindrical hollow piston which is displaceable in a housing bore parallel to the slide housing bore, bounds at one end a metering pressure chamber connected to the metering passage and having a spring, bounds at the other end an operating pressure chamber connected to the cavity of the hollow piston and to the supply passage, and comprises at least one throttling position which is connected to the pump connection by way of a fixed control orifice, particularly an annular groove, disposed between the pressure chambers and is formed by control orifices which extend from the cavity, particularly radial bores. The pressure regulator and slide valve can be arranged in a module to save space in such a way that a plurality of such units may be assembled next to each other and provided with common pump and container passages.

The invention will now be described in more detail with reference to a preferred example illustrated in the single drawing which shows a slide valve according to the invention in cross-section together with the associated pressure regulator and diagrammatically indicated parts of the installation.

The illustrated slide valve 1 comprises a housing 2 having a housing bore 3 for receiving a slide 4. A pump passage 5 and two container passages 6 and 7 extend transversely to the housing bore 3. If a plurality of housings 2 are juxtaposed, the pump and container passages of these housings are in registry with each other. The pump passage 5 leads to a pump connection 8 to which pressure fluid can be fed from a container 10 by a pump 9. The container passages 6 and 7 each lead to a container connection 11 and 12, respectively, which are connected to the container 10. The passage 5 leads by way of a pressure regulator 13 to a supply passage 14. The slide valve 1 serves to operate a load 15, in this case a servo-motor. For this purpose, two load connections 16 and 17 are provided in the housing 2.

The housing bore 3 comprises seven control orifices in the form of annular grooves. In the middle there is a supply passage control orifice 18 connected to the supply passage 14. At both sides, two metering passage control orifices 19 and 20 are provided in close juxtaposition; these are directly interconnected and lead to a metering passage 21. Further outside, two load connection control orifices 22 and 23 are provided symmetrically. At the very outside there are two symmetrical container connection control orifices 24 and 25. At both sides of a central dividing wall 26, the slide 4 has a cavity 27 and 28 closed at the ends by a plug 29 or 30. A screwthread 31 of plug 30 serves to secure an actuating element. Control orifices leading from the cavities, in this case in the form of radial bores of equal size, extend to the cylindrical circumference. There are inner control orifices 32 and 33, namely radial bores, adjacent to the dividing wall 26 and outer control orifices 34 and 35, here in the form of four radial bores, which are axially offset with respect to the plugs 29 and 30.

The dimensions are such that the central section 36 of slide 4 remaining between the inner control orifices 32 and 33 in the neutral position completely covers the supply passage control orifice 18 and partially covers the closely adjacent metering passage control orifices 19 and 20. The load connection control orifices 22 and 23 are closed in the neutral position by the slide sections 37 and 38 remaining between the inner and outer control orifices. The outer slide sections 39 and 40 cover the container connection control orifices 24 and 25 except for a small section which, by reason of overlap with the outer control orifices 34 or 35, forms a throttling position 41 or 42, respectively. Consequently, the metering passage 21 is connected to the container connections 11 and 12 in the neutral position.

If, for example, the slide 4 is displaced to the left, the metering passage control orifice 19 is first closed. The supply passage control orifice 18 thereupon opens towards the cavity 28 by way of the inner control orifice 33. At the same time, the outer control orifice 35 is connected to the load connection control orifice 23. Similarly, the cavity 27 is connected on the one hand to the load connection control orifice 22 by way of the inner control orifice 32 and to the container connection control orifice 24 by way of the outer control orifice 34. The conditions are similar when the slide 4 is displaced to the right.

The pressure regulator 13 comprises a cylindrical hollow piston 43 which is displaceable in a bore 44 of a housing 45 parallel to the slide 4. The housing 45 is placed against the housing 2 with the interpositioning of sealing elements 46. The hollow piston 43 bounds a metering pressure chamber 47 which communicates by way of a bore 48 with the metering passage 21 and comprises a spring 49. The metering pressure chamber 47 is otherwise bounded by a screwthreaded stud 50 containing an overpressure valve 51 with the aid of which the metering pressure chamber 47 can be vented to the container passage 7 by way of a passage 52. On the other side, the hollow piston 43 bounds an operating pressure chamber 53 connected to the supply passage 14. The cavity 54 of the hollow piston 43 communicates with this operating pressure chamber 54 by way of a check valve 55. In the bore 44 there is a control orifice 56 which is in the form of an annular groove, co-operates with control orifices 57 of the hollow piston in the form of radial bores, and defines a throttling position 58 disposed between the pump connection 8 and the supply passage 14.

In addition, the individual metering passage 21 is connected by way of a check valve 59 to a collecting metering passage 60 which leads by way of a connection 61 to the control input of a common pressure regulator 62 which is also subjected to the pump pressure and a spring 63.

The pressure regulators 13 and 62 function in a manner known from DE-AS 25 14 624. If the slides 4 of all slide valves 1 of the arrangement assume the neutral position, the container pressure obtains in the individual metering passage 21 as well as in the collective metering passage 60. The pressure regulators 13 and 62 assume a rest position predetermined merely by the springs 49 and 63. By way of example, the pump pressure is set to 6 bar. If one of the slides 4 is adjusted, load pressure obtains in the associated individual metering passage 21. The associated pressure regulator 13 so adjusts itself that the pressure in the supply passage 14 assumes a value that is higher than the load pressure by an amount predetermined by the spring 49. This ensures that the pressure drop between the supply passage 14 and the one cavity 27 or 28 remains constant and the amount of pressure fluid supplied to the load 15 is approximately proportional to the adjustment of the slide 4. At the same time, this load pressure is also fed by way of the collective metering passage 60 to the pressure regulator 62 which regulates the pump pressure to a value somewhat above the pressure to be set by the pressure regulator 13. If one or more slide valves are actuated, the function of each individual valve will be as described above. The pressure regulator 62 will, however, in that case be controlled by the highest load pressure so that an adequate pump pressure will be available for all operating purposes.

The pressure regulator 62 can also be embodied in a manner other than by a diverting valve, for example by adjusting the delivery volume of an adjustable pump.

I claim:

1. A hydraulic control valve, comprising, a housing having a cylindrically shaped bore, said housing having pump and tank connections and two servomotor load connections, said bore having a supply orifice, said bore having a pair of metering control orifices on opposite sides of said supply orifice in closely spaced relation thereto, said bore having a pair of inner load control orifices on opposite sides of said metering control orifices, said bore having a pair of outer exhaust orifices on opposite sides of said load control orifices, all of said orifices being in the form of annular grooves, said housing having passage means connecting said supply orifice to said pump connection and passage means connecting said load control orifices to said load connections, said housing having passage means connecting said exhaust orifices to said tank connections, a slide member disposed in said bore and being axially displaceable relative thereto, said slide member having axially inner and outer changeover ports cooperable with said orifices upon movement of said slide member in opposite directions to selectively connect opposite ones of said motor connections to said pump and tank connections, said inner changeover ports being separated by a center section which when said slide member is in a neutral position covers said supply orifice and places said metering orifices in fluid throttling communication with said inner changeover ports, said slide member having two cavities formed by two end walls and a central wall, said inner and outer ports having fluid communication with said cavities with said inner ports being adjacent said central wall and said outer ports being adjacent said end walls, said metering control orifices being sufficiently closely adjacent said supply orifice that when in operation when said supply orifice is partially overlapped by one of said inner ports one of said metering control orifices on the opposite side of said supply orifice is closed by said central section of said slide member, the inner edges of said inner changeover ports partially overlapping both of said metering control orifices when said slide member is in the neutral position, and said housing exhaust orifices having their axially inner edges slightly overlapping said slide member outer changeover ports in the neutral position.

2. A control valve according to claim 1 characterized in that said slide member inner and outer changeover ports are radial bores.

3. A control valve according to claim 2 characterized in that said radial bores are of equal size with the number of said outer changeover ports being larger than the number of said inner changeover ports.

* * * * *